United States Patent [19]

Suk

[11] Patent Number: 4,605,050

[45] Date of Patent: Aug. 12, 1986

[54] GOLF CLUB HEAD COVERS

[76] Inventor: Young J. Suk, 59 Sandy Hollow Rd., Port Washington, N.Y. 11050

[21] Appl. No.: 639,263

[22] Filed: Aug. 9, 1984

[51] Int. Cl.[4] ..... A63B 57/00

[52] U.S. Cl. ..... 150/52 G; 40/10 D; 273/32 R

[58] Field of Search ..... 273/162 R, 162 F; 150/52 G; 40/10 R, 10 D, 915

[56] References Cited

U.S. PATENT DOCUMENTS

| | | | |
|---|---|---|---|
| 3,133,577 | 5/1964 | Bellevue, Sr. | 150/52 G |
| 3,295,236 | 1/1967 | Wishnia | 40/10 R |
| 3,593,769 | 7/1971 | Spears | 150/52 G |
| 3,645,022 | 2/1972 | Anderson | 40/10 R |

*Primary Examiner*—William H. Grieb

*Attorney, Agent, or Firm*—Brady, O'Boyle & Gates

[57] ABSTRACT

A golf club head cover utilized for protecting the heads of golf clubs, such as the "woods" from rain and other inclement weather as well as damage resulting from the striking of other clubs being carried in a golf bag during the playing of the game of golf and also during transport. A head cover in accordance with this invention deletes the dedicated numbering corresponding to the particular golf club to be covered in favor of a transparent window in the body of the head cover in the upper region thereof so that the numbering appearing on the sole plate of the club itself provides the required club identification when covered, whereby one may select a golf club such as a "wood" by directly viewing the sole plate of the club through the window when making a club selection. This permits one or more identical head covers in accordance with this invention to be used with any numbered wood club in the bag as opposed to being used with the specific club which is like numbered.

8 Claims, 5 Drawing Figures

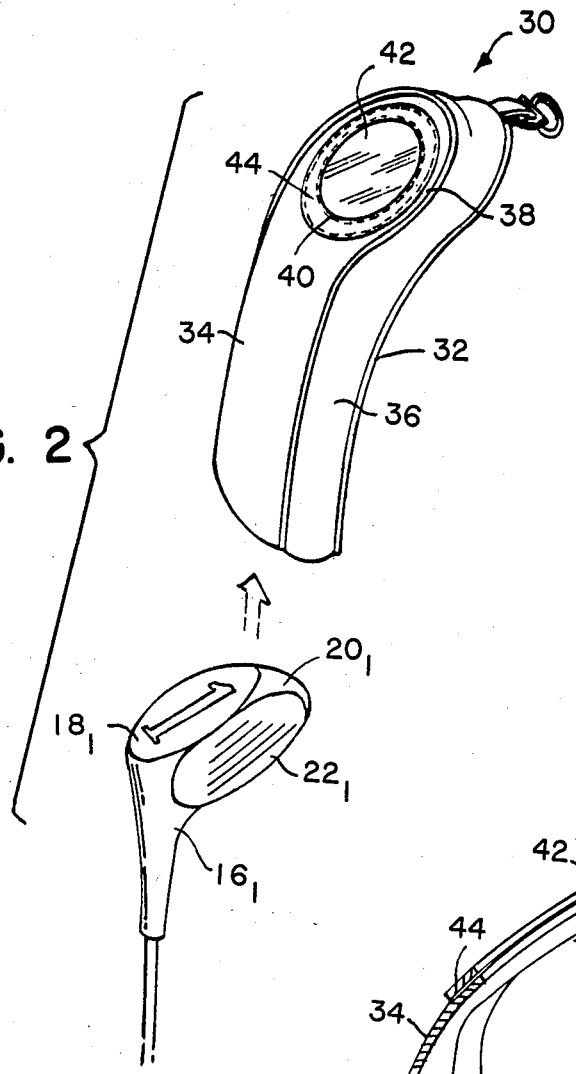
FIG. 2
FIG. 3
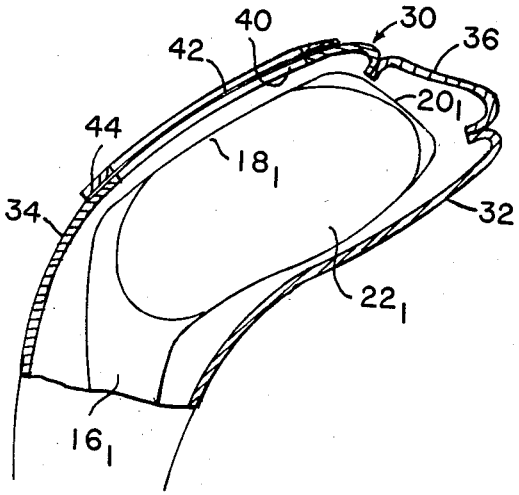

GOLF CLUB HEAD COVERS

BACKGROUND OF THE INVENTION

This inventon relates generally to accessories for golf clubs and more particularly to golf club head covers.

The number of golf clubs used in the game of golf is limited to 14 clubs and typically includes four wood clubs or "woods", nine iron clubs or "irons" and one putter. The use of head covers for the protection of the golf clubs when carried in a bag is well known, particularly when used in connection with the woods for protecting the clubs not only from rain and other inclement weather conditions, but also from damage due to the clubs being jostled against one another when being carried as well as during their removal and replacement during the playing of a round of golf. The use of head covers has not been exclusively restricted to the woods since head covers have also been made which are adapted for use with "irons" as well as putters.

Notwithstanding the fact that the prior art discloses the use of transparent covers, hoods and canopies which are adapted to fit over the top of a golf bag to envelop all of the golf clubs contained in a golf bag, head covers for the individual clubs generally include some form of a numerical indicia for indicating the specific numbered club with which the head cover is to be utilized and thus one selects a golf club, typically a wood club, by referring to the indicia carried by the head cover. Moreover, head covers are normally manufactured and sold as a set and being numbered such as 1, 2, 3, 4; 1, 3, 5, - ; etc. Thus when a specific numbered head cover is lost or otherwise missing, a new set of head covers must be acquired or otherwise matched to another set or a mixed set of various types of head covers must be resorted to. This is not only undesirable, but can result in considerable expense where one desires a set of head covers of the same styling and construction.

Several attempts have been made to overcome this problem with disclosure of head covers having replacable number indicating elements. Such apparatus is shown in U.S. Pat. No. 3,295,236, I. Wishnia and U.S. Pat. No. 3,645,022, R. F. Anderson. The Anderson patent is of particular interest in that it discloses a removable thin transparent panel or disk which carries a number or other indicia thereon. However, it does not provide a window into the interior of the head cover so that the club itself may be directly viewed due to the fact that a backing material element is interposed therebetween.

Accordingly, it is an object of the present invention to provide an improvement in the means for covering the heads of golf clubs.

It is a further object of the invention to provide an aid in the selection of golf clubs obscured by head covers; and It is another object of the invention to provide a golf head cover of a universal type which can be used to identify any numbered club covered thereby; and It is yet another object of the invention to provide an improvement in head covers for golf clubs which permits the direct viewing of the golf club and numerical indicia carried thereby.

SUMMARY

The foregoing and other objects of the invention is provided by a covering for the head of a golf club having a head cover body including an opening and transparent window member secured to the body at the opening and being located so as to be in substantial registration with the club identifying indicia portion of the golf club to be covered thereby, such as the sole plate of a wood which carries the club number thereon. In a wood club head cover, the transparent window is located in the upper outer body portion of the head cover otherwise conventionally constructed and utilizing any desired material such as leather, synthetic resins and knitted fabrics.

DESCRIPTION OF THE DRAWING

While the present invention is defined in the claims annexed to and forming a part of this specification, a better understanding can be had by reference to the following detailed description taken in conjunction with the accompanying drawings in which:

FIG. 2 is a perspective view of a head cover incorporating the features of the subject invention as well as a golf club to be covered thereby;

FIG. 3 is a partial longitudinal cross sectional view of the head cover shown in FIG. 2 with a wood golf club inserted therein;

DESCRIPTION OF THE PREFERRED EMBODIMENT

Figure 1:
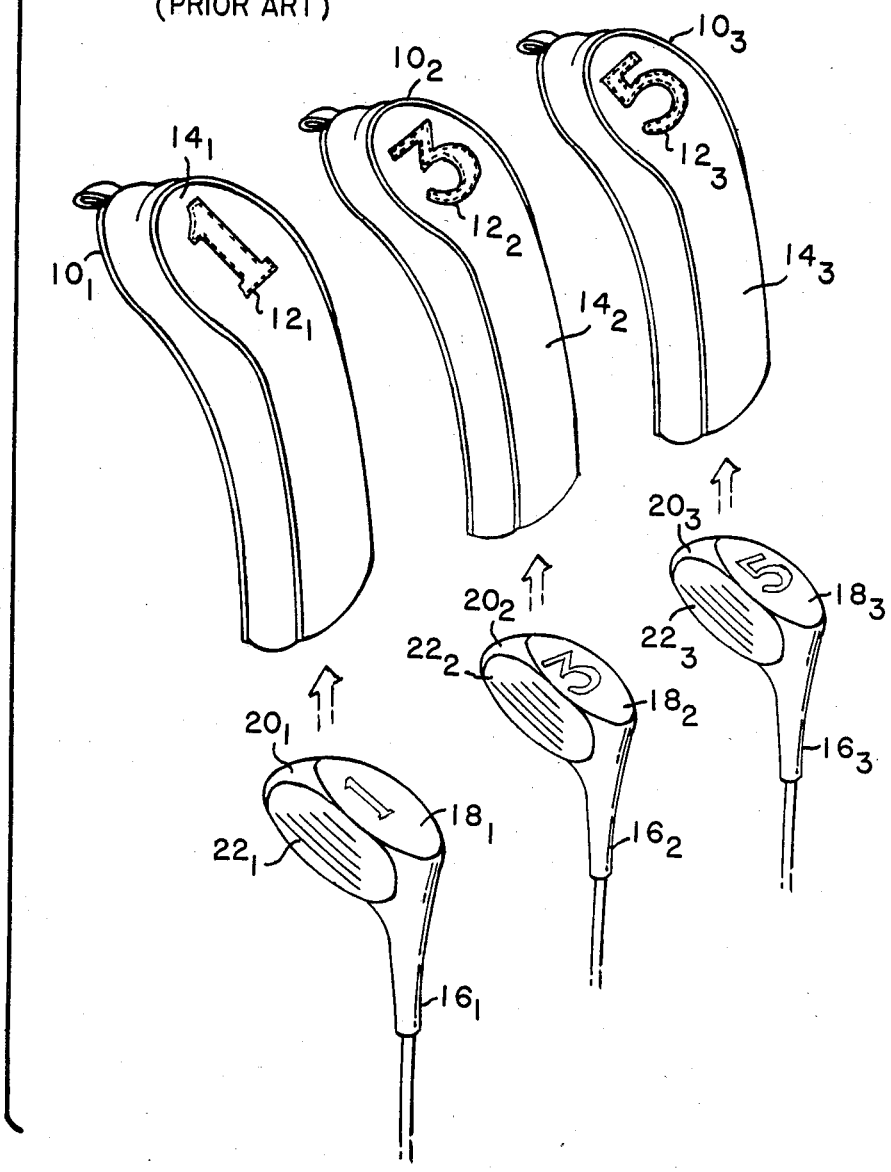
FIG. 1 (PRIOR ART)
FIG. 1 is a perspective view of a set of conventional golf club head covers of the known prior art and their associated like numbered wood clubs to be covered thereby.

Referring now to the drawings and more particularly to FIG. 1, shown thereat is a set of three head covers $\mathbf{10_1}$, $\mathbf{10_2}$ and $\mathbf{10_3}$ typically illustrative of the known prior art and having indicia affixed thereto in the form of specific numbers $\mathbf{12_1}$, $\mathbf{12_2}$ and $\mathbf{12_3}$ which are permanently secured such as being stitched to the upper portion of the outer body panels $\mathbf{14_1}$, $\mathbf{14_2}$ and $\mathbf{14_3}$. The numerical indicia $\mathbf{12_1}$, $\mathbf{12_2}$ and $\mathbf{12_3}$, thus specifically dedicates each head cover for use with a like numbered golf club. Accordingly, as shown in FIG. 1, three golf clubs $\mathbf{16_1}$, $\mathbf{16_2}$ and $\mathbf{16_3}$ in the form of "woods" each include number bearing sole plates $\mathbf{18_1}$, $\mathbf{18_2}$ and $\mathbf{18_3}$ affixed to the bottom portion of the club heads $\mathbf{20_1}$, $\mathbf{20_2}$ and $\mathbf{20_3}$. The three woods, however, have striking faces $\mathbf{22_1}$, $\mathbf{22_2}$, and $\mathbf{22_3}$ having different angles of loft so as to impart a higher trajectory as the number of the club increases from 1, 2, 3, 4, 5, etc. As shown, wood clubs bearing the numbers "1 ", "3" and "5" are respectively applied to the sole plates $\mathbf{18_1}$, $\mathbf{18_2}$ and $\mathbf{18_3}$ to identify the loft of the particular club. Thus the three head covers $\mathbf{10_1}$, $\mathbf{10_2}$ and $\mathbf{10_3}$ bear the numbers "1", "3" and "5" to match woods so numbered.

Thus a club is put into its own covering so that the golfer can select a particular club, typically a wood, from among the several woods which may be carried in a golf bag, not shown, and thus a user always matches the identifying numbers on the head covers in accordance with the numbers marked on the heads of the clubs. It can be seen, therefore, that any set of conventional head covers is meant to be matched to the particular set of clubs carried. Notwithstanding the matching of club head to head cover, during the course of play head covers can become switched, causing the player not only inconvenience, but in some cases great frustration and aggravation. Secondly, and more importantly, the loss or misplacement of one or more specific numbered head covers can require the acquisition of a whole new set of head covers if corresponding suitable replacement(s) cannot be found.

This now leads to a consideration of the subject invention and a preferred embodiment thereof, which is illustrated in detail in FIGS. 2 through 5. The invention is directed to a head cover which can be utilized with any numbered club, with the club itself providing the identifying number for its selection from a set of golf clubs through a transparent window formed in the body of the head cover. While the embodiment shown in the figures is directed to a head cover for a "wood" club, it is not intended to be limited thereto, inasmuch as it is intended in a broad sense to include head covers for "irons" and in some instances putters. Such head covers are suitably modified and/or reconfigured to accommodate the shape and size of the particular golf club with which it is to be utilized.

Referring now to FIG. 2, shown thereat is a golf club head cover in accordance with the subject invention and which is identified by reference numeral 30. The head cover 30 is comprised of inner and outer body panels 32 and 34 joined together by a single relatively thinner side panel 36. Such configuration is similar to the head covers shown in FIG. 1 and is utilized, for example, in connection with a driver or No. 1 wood $\mathbf{16}_1$ (FIG. 1) and having a sole plate $\mathbf{18}_1$ bearing the numerical indicia "1" thereon. In use, the club head $\mathbf{20}_1$ when inserted into the head cover 30 at its lower end comes to rest at the top portion thereof, with the sole plate $\mathbf{18}_1$ projecting towards the outer body panel 34 as shown in FIG. 3.

Figure 4:
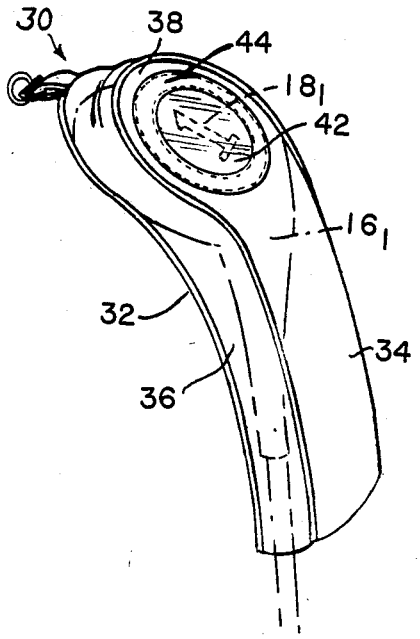
FIG. 4 is a perspective view of the golf club head cover shown in FIG. 2 with a wood golf club inserted therein and further being illustrative of the manner in which the number of the golf club itself is viewed through the window of the head cover in accordance with the subject invention.

Further as shown in FIGS. 2 through 5, the upper end portion 38 of the outer body panel 34 includes a transparent window comprised of a circular opening 40 formed in the upper body panel 34 which is covered by a circular transparent window element 42 comprised of relatively thin flexible material such as a transparent vinyl sheet. The transparent window element 42 is permanently held in place by a circular border member 44 stitched, for example, to the outer surface of the panel 34 as shown both in FIGS. 2 and 4. Thus as shown in FIG. 4, when the golf club $\mathbf{16}_1$, shown comprising a driver club, having the number "1" on the sole plate $\mathbf{18}_1$ is inserted into the head cover 32, the sole plate 18 is visible and can be viewed directly through the transparent window element 42 to read the identifying number on the club itself as opposed to having to rely on the numerical indicia appearing on the conventional type of head cover such as shown in FIG. 1.

Figure 5:
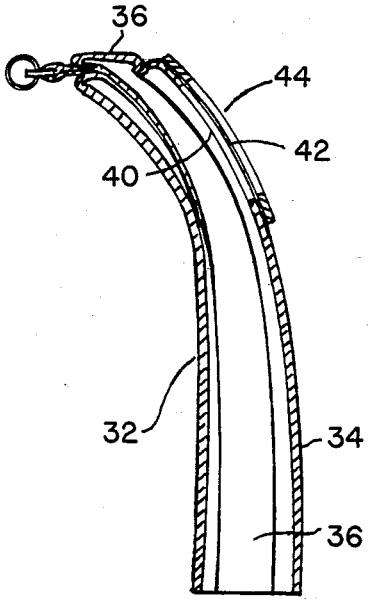
FIG. 5 is a further longitudinal cross sectional view of the head cover shown in FIG. 2 without a golf club therein.

FIG. 5 is merely intended to show a cross sectional view of the head cover in accordance with the subject invention without the golf club inserted therein and in its collapsed state.

It should be pointed out that both the construction of the head cover 30 and the window can take any desired shape in that while the window element 42 is shown to be circular, it is done merely for the sake of convenience and when desirable, can be formed, for example, as a square or rectangle or any other type of polygon as long as it is large enough to reveal the numerical indicia appearing on the golf club. Also, the head cover 30 itself can take many shapes and configurations other than that shown. For example, the cover can be configured in the form of a knitted sock, a shape well known to those skilled in the art, or it may even take the form of a mitten like structure consisting of two panels directly sewn together and being comprised of fur like material.

Where for example a head cover in accordance with the subject invention is to be used in connection with "irons", such head covers normally consist of molded plastic coverings conforming to the shape of the club heads and which are adapted to snap on and off the clubs. Such a head cover employing the concept of this invention would include, for example, a rectangular window in the sole portion of the snap-on cap.

Thus what has been shown and described is an improvement in head covers for golf clubs when the head cover includes a transparent window therein for the direct viewing of the golf club and its identifying number which is marked on the head of the club and therefore it can be used with any numbered club without having to be dedicated to a particular numbered club.

Accordingly, while there has been shown and described what is at present considered to be the preferred embodiment of the invention, modifications thereto will readily occur to those skilled in the art. It is not desired, therefore, that the invention be limited to the specific implementations shown and described, but it is intended to cover all such modifications, alterations and changes falling within the spirit and scope of the invention as defined in the appended claims.

I claim:

1. a universal type of head cover for a golf club, comprising:

a head cover body for receiving a golf club therein; and window means including an opening formed in the material of said head cover body for revealing the identifying portion of the golf club inserted therein and a transparent window member covering said opening and secured to said head cover body for protecting the golf club while revealing the identifying portion of the golf club.

2. The head cover as defined by claim 1 wherein said head cover body comprises means for covering the golf club known as a "wood".

3. The head cover as defined by claim 1 wherein said golf club comprises a wood club including a head which comes to rest at one end of said head cover body when inserted therein and wherein said opening and said transparent window member are located at said one end of said head cover body.

4. The head cover as defined by claim 1 where the identifying portion of the golf club comprises the sole plate of a golf club referred to as a "wood", wherein said sole plate carries an identifying number, and wherein said opening and said transparent window member is located at the region of said sole plate when the golf club is inserted in said head cover.

5. The head cover as defined by claim 1 wherein said opening comprises a generally circular opening and wherein said transparent window member is comprised of a relatively larger circular member covering said opening.

6. The head cover as defined by claim 1 wherein said transparent window member comprises a sheet of relatively thin flexible transparent material.

7. The head cover as defined by claim 6 wherein said transparent window member is comprised of a relatively thin, transparent vinyl sheet.

8. The head cover as defined by claim wherein said head cover body is comprised of at least two body panels comprising an inner body panel and an outer body panel and having a lower end for inserting the golf club and an upper end for containing the head of the golf club inserted therein and wherein said opening and said transparent window member are located in said outer body panel at said upper end.

* * * * *

UNITED STATES PATENT AND TRADEMARK OFFICE

CERTIFICATE OF CORRECTION

PATENT NO. : 4,605,050

DATED : August 12, 1986

INVENTOR(S) : Young J. Suk

It is certified that error appears in the above-identified patent and that said Letters Patent are hereby corrected as shown below:

Title page, column 1, add the following paragraph:

[30] Foreign Application Priority Data

May 9, 1984 [KR] Republic of Korea.....Ser.No. 4268

Signed and Sealed this

Second Day of December, 1986

*Attest:*

DONALD J. QUIGG

*Attesting Officer*

*Commissioner of Patents and Trademarks*